United States Patent [19]

Krutenat et al.

[11] Patent Number: 4,835,010

[45] Date of Patent: May 30, 1989

[54] ALUMINIDE DISPERSED FERRITE DIFFUSION COATING ON AUSTENITIC STAINLESS STEEL SUBSTRATES

[75] Inventors: Richard C. Krutenat, New Providence; Narasimha-Rao V. Bangaru, Bridgewater, both of N.J.

[73] Assignee: Exxon Research and Engineering Company, Florham Park, N.J.

[21] Appl. No.: 59,037

[22] Filed: Jun. 8, 1987

[51] Int. Cl.[4] ..... C23C 16/06

[52] U.S. Cl. ..... 427/250; 427/255.2

[58] Field of Search ..... 427/250, 252, 253, 255.2

[56] References Cited

U.S. PATENT DOCUMENTS

| | | | |
|---|---|---|---|
| Re. 29,212 | 5/1977 | Baldi et al. | 427/252 |
| 3,061,462 | 10/1962 | Samuel | 427/253 |
| 3,071,493 | 1/1963 | Whaley et al. | 427/252 |
| 3,096,160 | 7/1963 | Puyear | 427/253 |
| 3,108,013 | 10/1963 | Chao et al. | 427/253 |
| 3,167,403 | 1/1965 | Smith et al. | 427/252 |
| 3,276,903 | 10/1966 | Galmiche | 427/253 |
| 3,958,046 | 5/1976 | Baldi | 427/252 |
| 3,958,047 | 5/1976 | Baldi | 427/252 |
| 4,041,196 | 8/1977 | Baldi et al. | 427/252 |
| 4,350,719 | 9/1982 | Baldi | 427/253 |
| 4,617,202 | 10/1986 | Baldi | 427/253 |
| 4,687,684 | 8/1987 | Restall et al. | 427/252 |

FOREIGN PATENT DOCUMENTS

| | | | |
|---|---|---|---|
| 768535 | 12/1971 | Belgium | 427/253 |
| 536973 | 2/1957 | Canada | 427/253 |
| 691385 | 7/1964 | Canada | 427/252 |
| 899708 | 1/1982 | U.S.S.R. | 427/252 |
| 1145054 | 3/1985 | U.S.S.R. | 427/253 |

*Primary Examiner*—Sadie Childs

*Attorney, Agent, or Firm*—Ronald D. Hantman; Joseph J. Dvorak

[57] ABSTRACT

A process for the co-diffusion of aluminum and other elements into austenitic steel which includes heating the steel to a temperature at which co-diffusion occurs in the presence of a source of aluminum, a catalyst and metallic or metalloid elements having substantial solubility in ferrite (bcc phase of iron or iron alloy) so that a microstructure is formed on the steel which is a single layer composite and which includes a fine dispersion of compatible aluminide particles in a continuous ductile ferrite matrix.

15 Claims, 5 Drawing Sheets

SCHEMATIC ILLUSTRATION OF THE MECHANISM OF FORMATION OF THE INTERDIFFUSION REGION

PERFORMANCE OF Cr-Al COATINGS ON 253MA IN CYCLIC OXIDATION

ALUMINIDE DISPERSED FERRITE DIFFUSION COATING ON AUSTENITIC STAINLESS STEEL SUBSTRATES

BACKGROUND OF THE INVENTION

Protective coatings offer the prospect of minimizing material degradation under the severe operating environments commonly encountered in the aircraft, petroleum, chemical and synfuels industries. Metallic coatings based on Cr, Al and Si, either singly or in combination, have been in use for several decades to enhance environmental resistance of materials to high temperature corrosion, including high temperature oxidation and hot corrosion, particle erosion, ereosion-corrosion, wear and thermal degradation. Aluminum diffusion coatings (or "aluminide" coatings) represent by far the most widely used coatings. Much of the early development of these coatings was in the aircraft industry for jet engine applications. Demands of high temperature strength of substrate materials for these applications necessitated the use of Ni-base and Co-base superalloys. In contrast to the superalloys, Al diffusion coating technology for ferrous systems, such as the heat-resistant austenitic stainless steels, is lacking understanding and optimization. Heat-resistant stainless steels are widely used in petroleum, chemical, nuclear and other applications due to their excellent intermediate and high temperature strength and room temperature fabricability. Aluminizing of these stainless steels has thus received revived impetus of late as a means of improving the high temperature corrosion resistance of materials likely to be considered in many energy related applications.

Alonizing and other state-of-the-art aluminizing processes as conventionnaly carried out for surface modification of stainless and other steels invariably result in the formation of a multi-layer coating consisting of a major, continuous outer layer phase on intermetallic compounds [aluminides, $(Fe,Ni)_2Al_3$ or (Ni,Fe)Al or mixtures thereof] and as well a sub-layer of interdiffused zone made up of a continuous metal matrix, see FIG. 1 (A) labeled "Commercial Processing".

It has been found that the extremely brittle and crack-prone outer aluminide layer of the stateof-the-art aluminum diffusion coatings is not durable under field exposure conditions and besides does not provide the desired corrosion resistance for those applications involving intermediate to low temperature corrosive environments, such as experienced in coal gasification. In FIG. 2, it is seen that the outer aluminizing layer is cracked and non-durable in the three examples shown. On the other hand, the sub-layer has been found to have a high hardness in relation to the substrate, substantially higher toughness, durability and chemical resistance properties than those of the outer aluminide layer. For example, in alkali catalyzed gasification processes alkali was found to penetrate through cracks in the exterior aluminide layer on a commercially aluminized type 310SS, but not through the interdiffused sub-layer, see, e.g., Bangaru and Krutenat, *J. Vac. Sci. Technol.,* B2(4), Oct.-Dec, 1984. Critical examination of the interdiffused sublayer showed that it consists of a composite microstructure containing a dispersion of aluminide particles which are coherently bonded to the chromium enriched ferrite matrix, see FIG. 3. The dark particles in these micrographs are the alumind particles dispersed in a continuous ferrite matrix. This and the preferential portioning of steel's Si into the ferrite matrix provide the interdiffusion sub-layer a higher hardness than that of substrate austenite and a greater toughness than that of the exterior aluminide layer.

For low to intermediate temperature aggressive environments involving relatively high $PS_2$ and low $PO_2$ (i.e., reducing-sulfidizing), such as those encountered in many energy conversion processes, it has been shown that a high Cr level in the coating besides Al is beneficial. Thus, currently, duplex Cr-Al rich coatings are specified for these applications. Most widely used commercial duplex Cr-Al coatings are produced by a two-step process wherein a high temperature Cr-diffusion coating is formed first which is subsequently aluminized to form the duplex coating. One such company providing coatings is Alloy Surfaces Co., Wilmington, Delaware. These commercial duplex coatings suffer from the same disadvantages as those of simple aluminizing, i.e., formation of an outer brittle aluminide continuous layer.

Besides the environmental and mechanical debits associated with the formation of the exterior aluminide layer, it has also further implications on the ability to co-diffuse elements. The diffusion of Cr, for example, is extremely slow through the aluminide, thereby eliminating the possibility of co-diffusion of Cr and Al into the steel under normal coating conditions wherein the kinetics of aluminide formation are favored.

One objective of this invention is to produce on Type 304, 316, 310 austenitic stainless steels and others of similar composition a single layer coating consisting only of the interdiffused region, i.e.g, without the continuous exterior aluminide, by a novel diffusion aluminizing process. This allows the formation of a thick coating layer, see FIG. 1(B) labeled "New Conrolled Activity Processing". The essential requirements for this process to succeed is to maintain the activity of Al in the source equal to or below a level which precludes the formation of a continuous outer aluminide layer.

A second objective of the present invention is to co-diffuse two or more elements simultaneously by taking advantage of the absence of diffusion inhibiting exterior aluminide layer. Specifically, single-step Cr-Al rich duplex diffusion coating is produced on substrates of interest made up only of the interdiffusion layer.

A key objective of this invention is to create by diffusion alloying coatings of significant thickness (up to ~20 mils or ~500 μm) with sufficient Al such as to be "$Al_2O_3$ formers" during oxidation at high temperature, and sufficient Cr for "hot corrosion" resistance, i.e., resistance to sulfur attack.

SUMMARY OF THE PRESENT INVENTION

The present invention is a process for the co-diffusion of aluminum and other elements into austenitic steel. The process includes heating the steel to a temperature at which co-diffusion occurs in the presence of a source of aluminum, a catalyst and metallic or metalloid elements having substantial solubility in ferrite (bcc phase of iron or iron alloy) so that a microstructure is formed on said steel which is a single layer composite and which includes a fine dispersion of compatible aluminide particles in a continuous ductile ferrite matrix.

In the present invention, the novel diffusion coating produced is made up entirely of a ductile, durable and protective interdiffusion layer rich in Al and other protective elements. It involves a process for co-diffusing two or more elements, with Al being one of the elements, into austenitic stainless steels comprising heating such steels to a temperature over 1000° C. in the presence of a source of aluminum, an activator, and other metallic element(s) source(s) and additional pack constituents, either inert or those producing a protective gas cover.

In a preferred embodiment, the co-diffusant is Cr and the process is carried out in a controlled activity pack. Pack processing is the general name given to the surface treatment of metallic hardware in a packed bed reactor, where the pack aggregate serves to support the part and to generate in situ the chemical reactants necessary for the surface treatment.

DESCRIPTION OF THE PREFERRED EMBODIMENT

Figure 1:
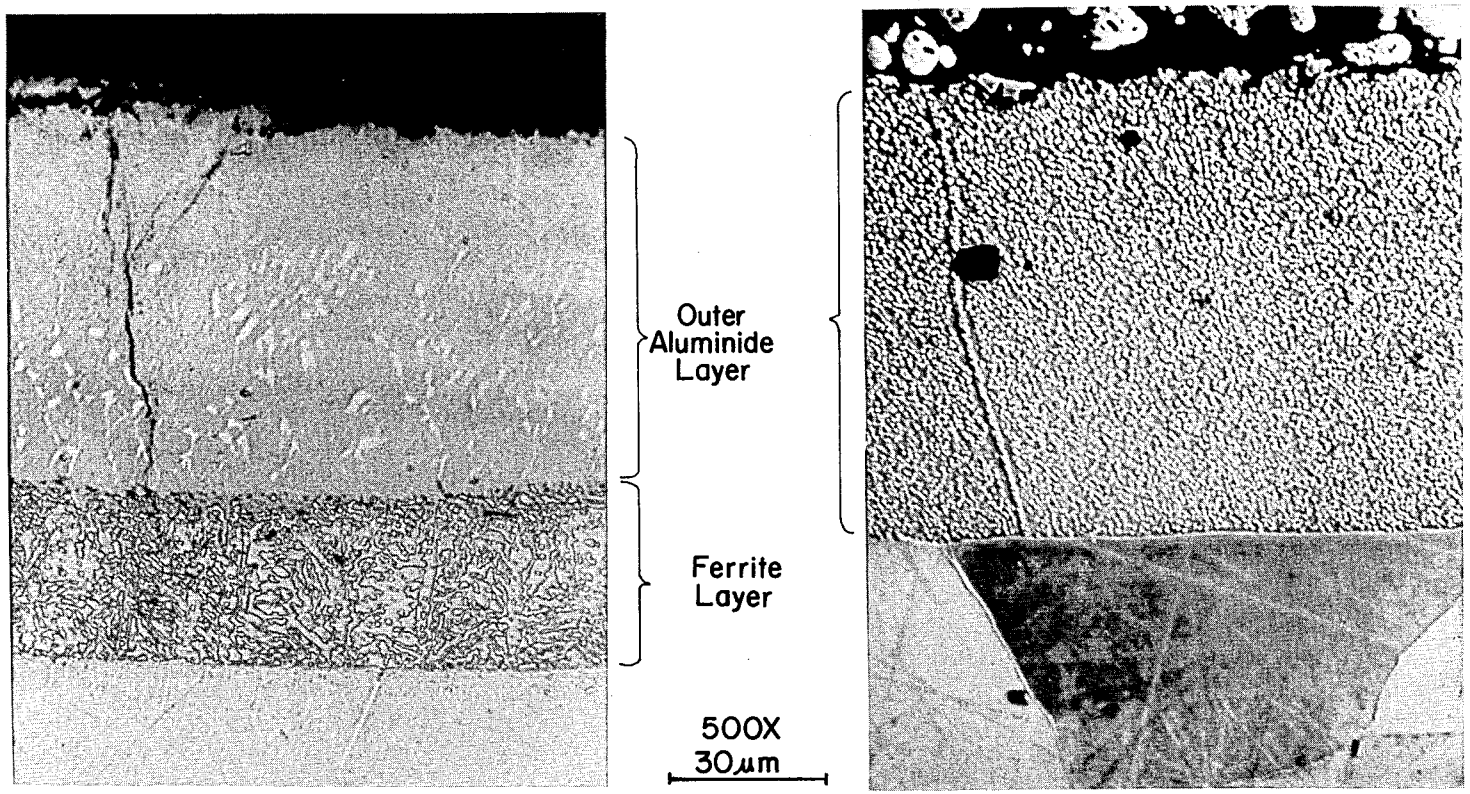
FIG. 1 shows a comparison of aluminized coatings: (A) conventional commercial technology; (B) controlled activity pack and diffusion (CAD) coating technology of the present invention.
Figure 2:
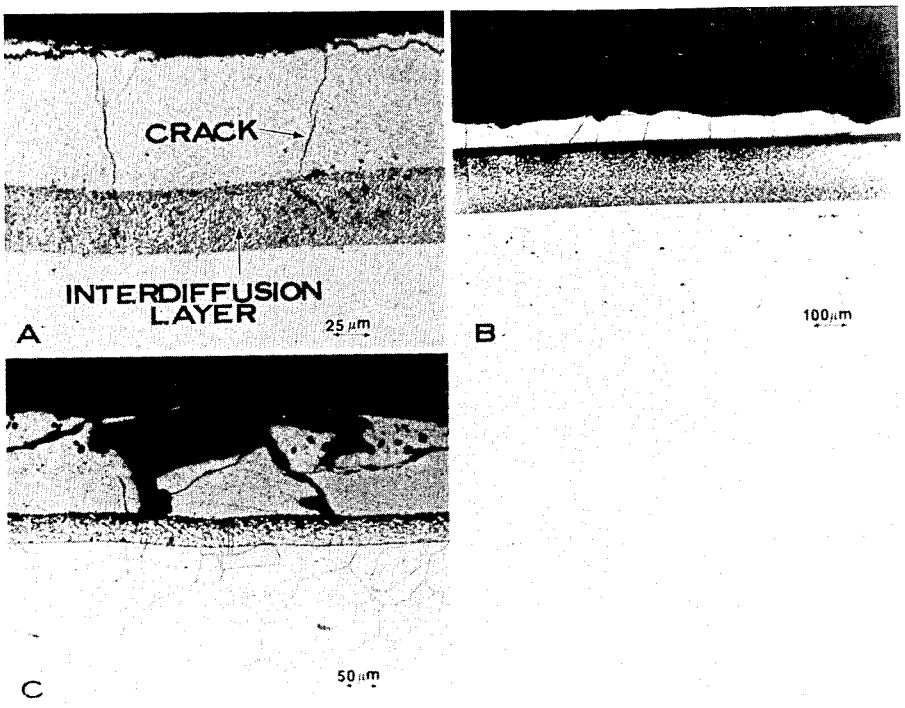
FIG. 2 shows the field performance of conventional Al diffusion coatings with the outer aluminide brittle layer: (A) conventional diffusion coating on 310 SS; (B) Alonized Type 321 SS; and (C) Alonized Type 304 SS. The interdiffusion layer marked on (A) is similarly present in the other two substrates. The outer aluminide layer is brittle and cracked in all cases after field exposure.
Figure 3:
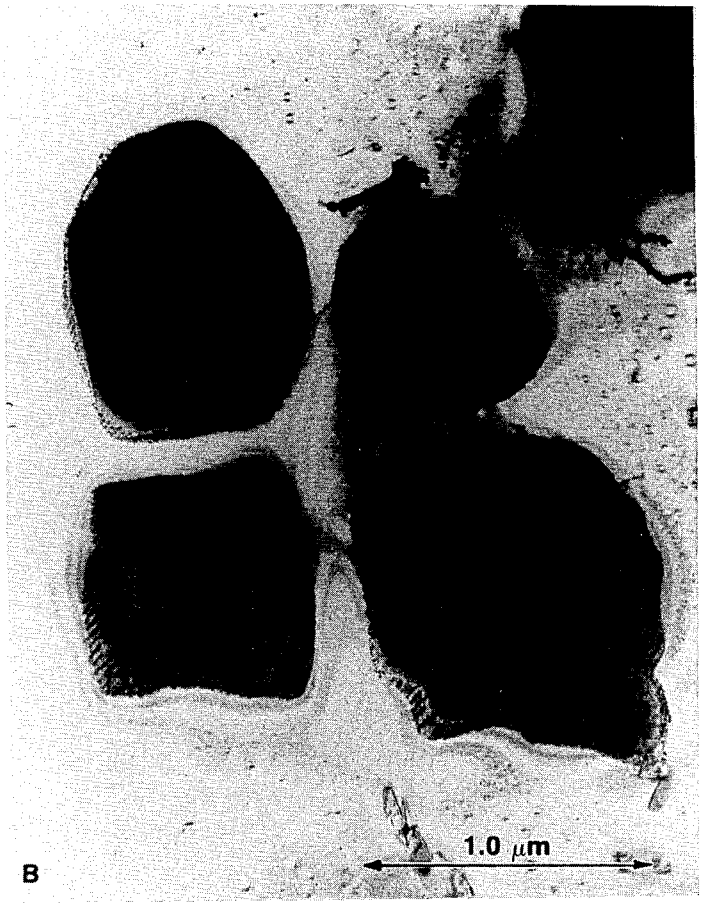
FIGS. 3 (A) and (B) show two transmission electron micrographs depicting the ferritedispersed aluminide composite structure of the CAD Cr-Al coating interdiffusion layer on 309 stainless steel at different magnifications.
Figure 3:
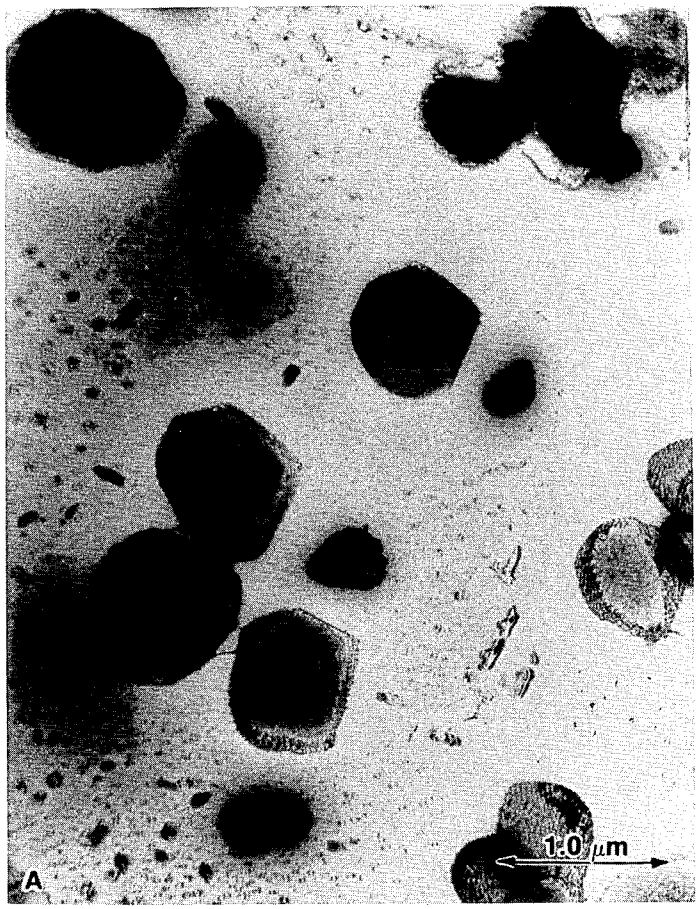

The coatings of the present invention are produced by pack diffusion method involving heating the target substrate in a retort packed with a mixture of ingredients a pack containing the source metal/alloy powder(s) for the element(s) to be diffused, an activator for delivering the elements to be diffused to the substrate surface, and an inerting pack filler material. These pack constituents, their influence on the coating, and their control to achieve the objectives of the present invention are described below. Also, in order to appreciate the technical approach used to accomplish the objectives of this invention it is important to understand the substrate metallurgy and the changes induced by the diffusion of coating elements at its surface. Thus, a brief description of the substrate metallurgy is given below, followed by the details of pack constituents.

I. Substrate Metallurgy

The major constituents in the austenitic stainless steel substrate besides Fe are Cr and Ni. Other minor but often important constituents include C, N, Si, Mn, Mo, Al, etc. Unalloyed Fe goes through an allotropic phase transformation upon heating wherein the ferrite (body centered cubic, bcc, crystal structure) phase stable at lower temperatures transforms at 910° C. to austenite (face centered cubic, fcc), the stable phase at higher temperatures. The major and minor alloying elements in stainless steels can be divided into two categories: (i) ferrite stabilizers which include Al, Cr, Mo, Si, and (ii) austenite stabilizers which include C, N, Ni, Mn. Within each category the potency of individual alloying elements in stabilizing respective phases differs widely. For example, Al and Mo are some of the most potent ferrite stabilizers knwon, while C, N and Ni are some of the most potent austenite stabilizers. Generally, the solubility of ferrite stabilizers is quite limited to austenite and vice versa.

In commercially important austenitic stainless steels the Cr and Ni additions are so delicately balanced as to give it a stable austenite phase throughout its intended exposure and use temperature regime. The austenite phase affords these steels some unique properties: excellent room temperature fabricability, toughness throughout the exposure temperature, including high temperatures, immunity to a variety of embrittlement phenomenon and, most importantly, excellent high temperature strength. In these respects these steels are vastly superior to the ferritic stainless steels. However, in several aggressive environments typical of energy conversion processes, wherein the environments are typically reducing-sulfidizing, it has been found that best corrosion reistance is offered by ferritic stainless steels, such as Fe Cr AlY (Fe - 20 to 30 weight percent Cr - 0 to 15% Al - 0 to 1% Y). Thus, for high tempeature strength and other mechanical property considerations, austenitic stainless steels are preferred, while for corrosion resistance considerations ferritic stainless steels rich in Cr and Al are preferred. An optimum approach, therefore, would be to produce a composite by, say, a diffusion coating of an austenitic stainless steel substrate wherein the surface region is converted to a ferritic phase. This is the main thrust of the present approach.

i. Mechanism of Formation of Interdiffusion Layer in Diffusion Coatings of Al

As discussed above, the protective elements, Al, Cr, Si, etc., in the coating for environmental resistance are all strong ferrite stabilizers. As the Al diffuses into the substrate during the coating process the austenite stability of the substrate is changed locally. This is due to several very important reasons. The solubility of Al in fcc austenite is extremely limited, while the solubility of Al in ferrite is very high. Hence, substantial aluminizing of the substrate is contingent upon the formation of ferrite locally at the surface. However, Ni, Mn and C in the substrate oppose any effort to "ferritize" the substrate due to their strong austenitizing tendency. Thus, the higher Ni substrates slow down the "ferritization" process induced by the Al diffusion in the substrate.

The heat resisting stainless steels represent a unique case for feritization by Al diffusion. Although Ni in these alloys strongly opposes any transformation of austenite, it also has a very strong affinity for Al to form the nickel aluminide compounds, which are some of the most stable intermetallic compounds known. Thus, as the Al diffuses into the substrate it can combine with Ni to precipitate locally the nickel aluminide, thereby depleting the substrate of an important austenitizing element. This triggers the austenite to ferrite phase transformation locally. The Al diffusion rate in the more open bcc ferrite is about two orders of magnitude higher than that in the tightly packed fcc austenite. Thus, the diffusion induced phase transformation to ferrite in turn helps the Al diffusion.

Figure 4:
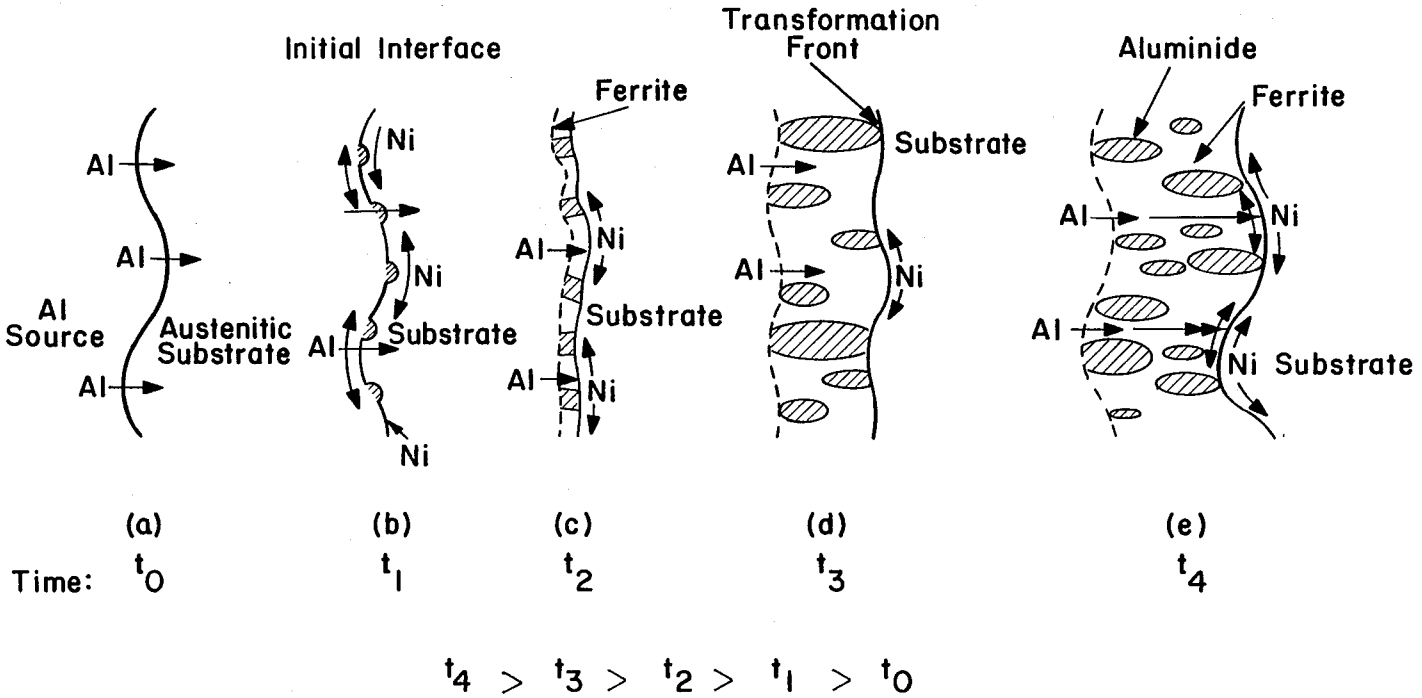
FIG. 4 shows a schematic of the mechanism of CAD coating interdiffusion layer formation on austenitic stainless steel substrates.

The evolution of the interdiffusion layer and the mechanism of its formation are schematically illustrated in the FIG. 4.

ii. Co-Diffusion of Other Ferrite Stabilizers Such as Cr

A key feature of this invention is the ability to co-diffuse other ferrite-stablizing elements, such as Cr, Mo, Si, Nb, V, Zr, etc., since the absence of a continuous exterior aluminide layer does not block access of these elements (halides) to the ferrite of the interdiffusion layer by virtue of the aluminides' low solubility for these elements and the exceedingly slow diffusion rates in it. In addition, the rapid ferritization achieved by Al diffusion at the surface promotes the incorporation of other heavier elements, such as Cr, Nb, Mo, etc., due to their high solubility and diffusion rates in ferrite compared to austenite.

Chromizing is known to occur more readily in ferrite than in austenite. In fact, when conventional chromizing is practiced on austenitic materials the high temperatures and long time required causes alpha chromium (95% pure Cr) to form on the surfaces, generally by sublimitation and condensation of Cr. Alpha chromium deposits are undesirable since their corrosion resistance in a sulfidizing condition, such as alkali catalyzed coal gasification, is poor compared with a surface concentration of 40% to 60% Cr in solid solution in ferrite phase.

II. Pack Ingredients (i) Source Element(s) Metal/Alloy Powders

An important objective of this invention is to eliminate the formation of the outer, continuous aluminide layer while promoting the formation of the interdiffusion layer. In order to accomplish this objective it has been found necessary and important that the activity of Al in the pack has to be controlled to a level below that which promotes the formation of outer aluminide layer. Controlled activity pack and diffusion (CAD) refer to this process.

When aluminum is alloyed with another metal its chemical potential or activity will be reduced approximately in proportion to its concentration in the alloy, i.e., taking the convention that the activity of pure metal is unity, a 50 atomic percent alloy would have an activity for that component of 0.5. Under circumstances where strong compounds are formed between the elements of an alloying pair the activity of an element can be far less than that calculated from atomic concentration of that element in the alloy. For example, when Ni and Al are alloyed at 50 atomic percent each then a very strong intermetallic compound, NiAl, is formed. In this case the activity of Al in the alloy would be much less than 0.5 calculated from its concentration. Thus, Ni-50 at % Al (or Ni-30 Wt. % Al) will have an activity of Al which is approximately equivalent to that in an alloy of Fe-10 Wt. % Al, or Cr-10 Wt. % Al although in the latter two cases the atomic percent of Al is less than half of the Ni-30 Wt. % Al alloy.

For this invention Ni-30 Wt. % Al is one of the controlled activity source alloys considered for Al. This Al source theremodynamically disallows composition in the diffused material which exceeded the activity of Al in Ni-30 Wt. % Al, the purpose being to avoid the formation of discrete exterior layers of NiAl intermetallic compound on the austenitic stainless steel substrate surface. In subsequent experiments, for example, using type 304 SS substrate, it has been discovered that the resulting ferrite layer could be simultaneously chromized to greater than 40 weight percent by adding Cr to the above pack mixture.

Figure 5:
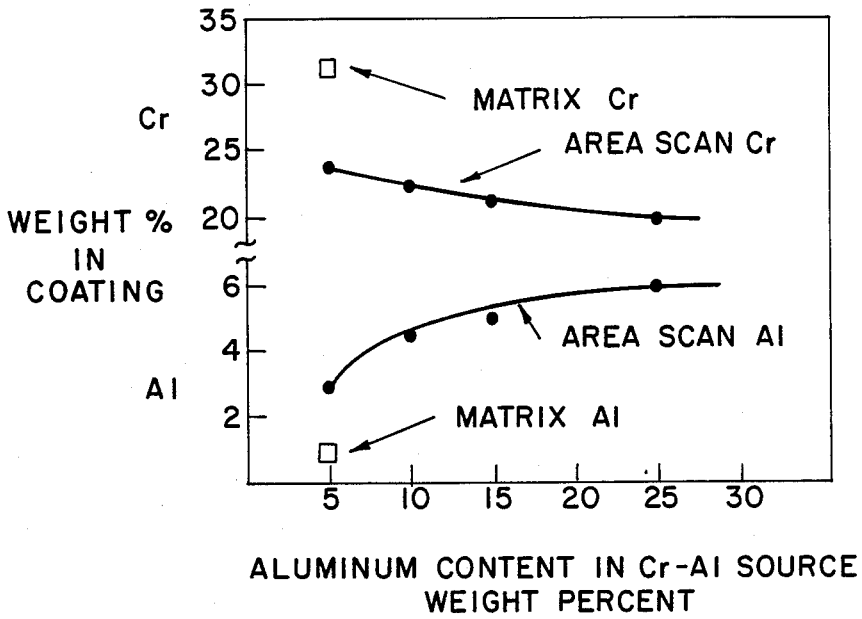
FIG. 5 shows the concentrations of Cr and Al as a function of source alloy for the Cr-Al CAD coating on 253 MA stainless steel. The figure shows the effect of Cr-Al source activity on 253 MA coating composition as determined by microprobe with large area scans and spot mode. In this case, the coating was produced by processing at 1171° C., 6 hrs, using CuCl activator. Area scans were made over a substantial fraction of coating thickness and represent average coating compositions. The phenomenon of diffusion with phase transformation causes shallow gradients from the edge to coating-substrate interface.

In other experiments it has been shown that carefully selected Cr-Al alloys would function acceptably providing both Cr and Al from the same metallic alloy is used as diffusant source in the pack. Experiments were conducted in which the metallic source alloy compositon varied from Cr-5 weight percent Al, Cr-15 weight percent Al to Cr-25 weight percent Al. FIG. 5 shows the amount of Cr and Al transferred in the coating process to the substrate, in this case Sandvik 253 MA austenitic stainless steel. As the Al content in the source is increased the amount of Al in the coating increased from 3 weight percent (for Cr-5 weight percent Al source alloy) to 6 weight percent (for Cr-25 weight percent Al source alloy). Likewise, Cr contents on average analyses decreased as expected, since Cr activity in the source decreases as the Al activity increases. As can also be seen in FIG. 5, analysis of the ferrite matrix phase of the interdiffusion layer revealed much higher Cr but lower Al than the averages for the whole coating layer. This is because Cr preferentially partitions into the ferrite matrix while Al preferentially partitions into the nickel aluminide dispersions of the interdiffusion layer.

For some select alloys it was found that a source alloy of Cr-15 weight percent A1 functioned well to provide a coating with interdiffusion layer having internal aluminide precipitates, but no exterior aluminide layer, continuous in nature. For the purpose of simplifying pack formulation where both Cr and Al codiffusion is desired, Cr-Al alloys are very suitable and recommended.

The scope of this invention includes in the source alloy other elements having high solubility in the ferrite which is substantially formed by the fast diffusing Al into the austenitic substrate as discussed earlier. Such additions could include Mo, Nb, V, Ti and other elements or alloys thereof which promote ferritization of otherwise austinite stable alloys. The semi-metals and semi-conductor elements, such as B, Si, Ge and others, such as Sb, can also be considered for co-diffusion.

It is also well known that "active" elements, such as Ce, La, Y and others, if added to alloys and coatings that are $Al_2O_3$ formers (on oxidation) will promote scale ($Al_2O_3$) adherence. This is simply demonstrated in the literature, but not well understood. It is very difficult to incorporate active elements into the diffusion coatings, primarily because of their extreme reactivity and slow transport, both through the vapor phase in the pack to the surface of the substrate as well as into the substrate. In the present invention it has been discovered that measurable (~0.04 weight percent) amounts of Y can be incorporated into the coating using prealloyed powders of the type Cr-5 Wt. % Y as source for Cr and Y in addition to an Al source.

Other controlled activity source alloys that have been used with success are CoAl intermetallic, Fe-10Al and Fe-30Al alloys for low nickel stainless steels.

(ii) Activator

These are vital ingredients of a pack. Packs will not function unless a halide, volatile and reactive, can react with the source alloy powder, form intermediates which transport by gaseous diffusion to the object's surface, react with the surface to deposit the source element at the surface, and thereby regenerate the activator molecule again for further transport.

Ammonium salts, particularly the chlorides and fluorides, are commonly used. Ammonium fluoride was used with success in this work. It promotes Al transport more so than Cr transport. It is, however, highly toxic. Alumunim fluoride is also acceptable. It is a condensed phase activator at the pack temperatures of up to about 1200° C. and is also less toxic than ammonium salts. Furthermore, CuCl and CuI have also been found to be acceptable activators. They both are condensed phase salts of acceptable toxicity. In general, the condensed phase activators tried in this invention, such as $AlF_3$, $YCl_3$, CuCl, CuI, were found to produce more consistent results, have an economic and environmental advantage over the widely used ammonium halides.

The type of halide used influences the relative amounts of Cr and Al in the coating when codiffusion is carried out. The ranking of halides for high coating Cr contents is as follows: iodide>chloride>fluoride. The reverse is true for Al levels in the coating: viz, a fluoride activator produces the highest Al levels in the coating.

(iii) Pack Filler Materials

Inert filler ingredients in pack diffusion coating processes serve several important purposes: (1) provide mechanical support for an object to be coated; (2) as a pore former in the pack to provide many gas paths for transporting the source metal to the object's surface; (3) to prevent sintering of the metallic source alloy particles to each other, so that the coated object can be retrieved easily without cleaning steps to remove bound particles; and (4) to stand-off alloy particles from the object's surface so that they are less prone to sinter to the surface of the object. Moreover, in a retort inert material fills space and displaces unwanted air.

Obviously, inert ingredients must not be attacked by the activator to any appreciable extent and they must be chemically indifferent to the reacting species, the source alloy and the object.

Of necessity, because of the high affinity of Al and Cr for oxygen the inert must be stable to reduction by these metals. Hence, $Al_2O_3$, $ZRO_2$ and other highly stable oxides are the usual choice. $Al_2O_3$, because of its high stability and relatively low cost, is the inert of choice.

In the course of the present invention it has been found that when $Al_2O_3$ is used alone with a fluoride activator some pack sticking can occur. It has been discovered that a complete or partial substitution of $Al_2O_3$ with AlN (aluminum nitride) could prevent the sticking. The minimum amount of AlN was 10%, mixed with $Al_2O_3$. Because AlN is an extremely fine powder it tended to coat $Al_2O_3$ particles and kept them apart, thus preventing sticking.

AlN addition to the pack was found to be beneficial in other ways. It reacts with moisture in the pack at ambient temperature to form $Al_2O_3$ and $NH_3$. The ammonia ($NH_3$) is a good reducing gas for pack processing. Above about 600° F., AlN will also react with oxygen to form $Al_2O_3$ and nitrogen. This elimination of pack contaminants of an oxidizing nature proved to be extremely important for the good operation of a high temperature pack with low Al activity. For these reasons AlN in some fraction above ~10% is a key and desirable ingredient for good pack performance.

EXAMPLES OF PACKS AND COATINGS PRODUCED (i) Controlled Activity Aluminizing

Using a controlled activity pack source consisting of NiAl (Ni-30 Wt. % Al) powder (10=50% of pack) and ammonium halide activator (1% of pack) in a balance of $Al_2O_3$ and/or AlN, a rapid inward diffusion of Al by conversion of substrate austenite to ferrite was accomplished without forming an exterior aluminide layer. This process is favored by holding the pack at high temperatures (2100° F.–2200° F.) for short times (1 to 6 hours). At lower temperatures (1800° F–2000° F.) for longer times (10 to 24 hours) some exterior aluminide was seen to develop.

(ii) Codiffusion of Al and Cr

It has been found that addition of pure Cr (10 to 20% of pack) to the pack described in (i) above does provide, in addition to Al, Cr surface enrichment up to about 45% without the formation of alpha chromium. For example, by holding a type 316 stainless steel for three hours at 2140° F. in a pack consisting of 29% NiAl, 20% Cr, 1% $NH_4I$, balance $Al_2O_3$, an interdiffused layer of approximately 150 microns (0.007") thickness is formed, having average concentrations of 31% Cr and 2% Al. This is an increase in Cr from the original content of 18 Cr. If higher Al contents are desired, $NH_4F$ in the place of iodine as the pack activator provides 22% Cr and 4% Al when processed similarly.

(iii) Co-Diffusion of Al and Cr Onto 253 MA Austenitic Stainless Steel

A novel austenitic stainless steel, 253 MA, contains minor amounts of misch metal (Ce, La and other rare earth elements). These minor additions ae nevertheless sufficient to provide the so called "active element effect" to improve the adherence of protective oxide scale. When the steel was aluminized or chrome aluminized by the controlled activity diffusion to produce a surface having sufficient Al to become an $Al_2O_3$ former, it was found that the pre-existing misch metal served very well to cause scale adherence.

Figure 6:
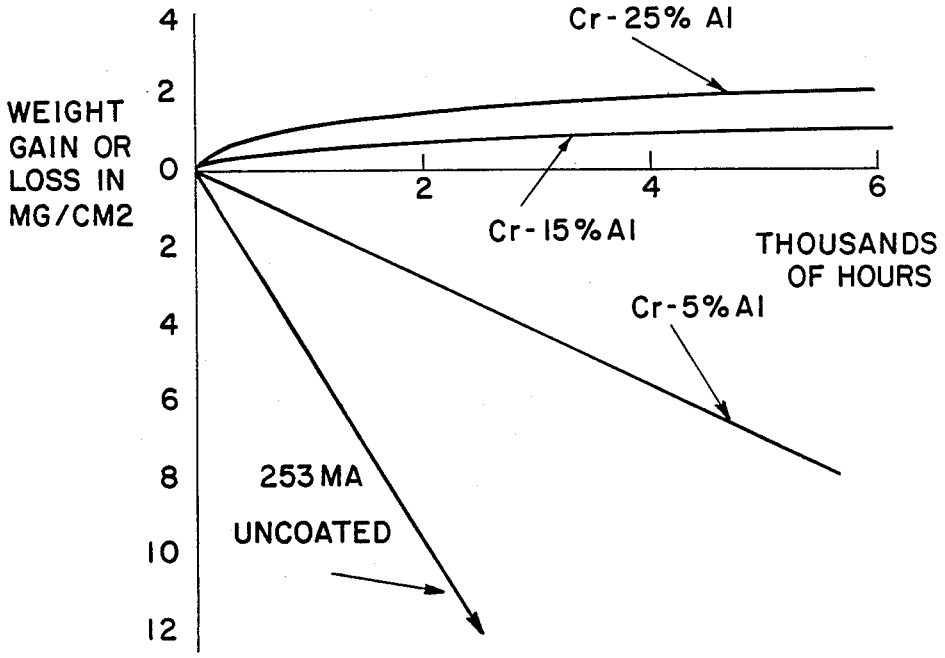
FIG. 6 shows the performance of CAD Cr-Al coatings on 253 MA substrates in cyclic oxidation tests as a function of source alloy used for the formation of the coating. The figures shows a comparison of oxidation behaviors of coatings made with varying Al-Cr source alloys, subsequently tested by air oxidation at 954° C. (1750° F.) for 5000+hours. Samples were air quenched and descaled periodically.

This was demonstrated to persist to over 5000 hours in a cyclic test in which the scale was periodically scrubbed after air quenching to encourage scaling, see FIG. 6. No significant scaling occured in samples where Cr-15Al or CR-25Al were used as sources in the pack for the CAD coating on 253 MA stainless steel. Coating thicknesses of 0.016" to 0.020" were formed in 6 hours at 1171° C. with a pack consisting of 30 weight percent Cr-15Al, 10% AlN, 2% CuCl, balance $Al_2O_3$.

(iv) Al or Cr-Al CAD Process as a Means of Producing Solid Shapes

The present invention may also be used in the formation of solid shapes of the material constituting the coating just discussed. In pursuit of this objective it is considered possible to pack treat powders of stainless steel with particle size in the range 0.02" (30 to 40 mesh size). After processing the particles, being ferritic, are easily separated from the pack. The powders are then consolidated by the usual methods, i.e., hot isostatic pressing, or canning in steel and hot extrusion. This then becomes an effective means of producing any shape desired, having an "Fe-Cr-Al-Y" ferrite, strengthened with coherent $NiAl/Ni_3Al$ particles uniformly distributed.

The same process can be extended to producing "Fe-Cr-Al-Y" ferrite fibers (0.02" to 0.04" in diameter) strengthened with $NiAl/Ni_3Al$ particles starting with austenitic stainless steel fibers.

What is claimed is:

1. A process for the simultaneous co-diffusing of aluminum and ferrite stabilizing elements into austenitic steel comprising heating said steel to a temperature at which co-diffusion occurs in the presence of a source of aluminum, a catalyst and ferrite stabilizing elements wherein the activity of the aluminum in said source of aluminum is below that which promotes the formation of an outer aluminide layer, and wherein said ferrite stabilizing elements are selected from the group consisting of Cr, Nb, Mo, V, Zr, Sn, W, Mn and Si whereby a microstructure is formed on said steel which is a single layer composite and which includes a fine dispersion of compatible aluminide particles in a continuous ductile ferrite matrix.

2. The process of claim 1 wherein said aluminum and ferrite stabilizing elements are introduced simultaneously.

3. The process of claim 1 wherein said source of aluminum is an aluminum alloy or aluminum inter-metallic compound.

4. The process of claim 3 wherein said source of aluminum is Cr-Al alloys.

5. The process of claim 4 wherein said source of aluminum is Cr-5% Al, Cr-15% Al, or Cr-25% Al.

6. The process of claim 3 wherein said source of aluminum is NiAl.

7. The process of claim 1 wherein said heating step is conducted in the presence of filler ingredients.

8. The process of claim 7 wherein said filler ingredients include $Al_2O_3$ or AlN and mixtures thereof.

9. The process of claim 1 wherein element is Mo.

10. The process of claim 1 wherein said element is Cr.

11. The process of claim 8 wherein said filler ingredient is $Al_2O_3$.

12. The process of claim1 wherein said catalyst include CuCl, CuI or $AlF_3$, ammonium halides.

13. The process of claim 12 wherein said catalyst is $NH_4Cl$ or $NH_4I$.

14. The process of claim 1 wherein said element is Si.

15. The process of claim 8 wherein filler ingredients include 90% $Al_2O_3$ and 10% AlN.

* * * * *